US010502519B2

(12) United States Patent
Stilson

(10) Patent No.: US 10,502,519 B2
(45) Date of Patent: Dec. 10, 2019

(54) PEPPER SPRAY PHONE CASE

(71) Applicant: Stilson, LLC, Draper, UT (US)

(72) Inventor: Eric Lyle Stilson, Draper, UT (US)

(73) Assignee: Stilson, LLC, Draper, UT (US)

( * ) Notice: Subject to any disclaimer, the term of this patent is extended or adjusted under 35 U.S.C. 154(b) by 0 days.

(21) Appl. No.: 16/365,556

(22) Filed: Mar. 26, 2019

(65) Prior Publication Data

US 2019/0310049 A1 Oct. 10, 2019

Related U.S. Application Data

(60) Provisional application No. 62/761,914, filed on Apr. 10, 2018.

(51) Int. Cl.

| | |
|---|---|
| ***F41B 9/00*** | (2006.01) |
| ***F41H 9/10*** | (2006.01) |
| ***A45C 11/00*** | (2006.01) |

(52) U.S. Cl.

CPC ..... *F41B 9/0084* (2013.01); *A45C 11/00* (2013.01); *F41B 9/0071* (2013.01); *F41B 9/0087* (2013.01); *F41H 9/10* (2013.01); *A45C 2011/002* (2013.01)

(58) Field of Classification Search

CPC .... F41B 9/0084; F41B 9/0071; F41B 9/0087; A45C 11/00; A45C 2011/002; F41H 9/10

USPC ..... 222/175, 78

See application file for complete search history.

(56) References Cited

U.S. PATENT DOCUMENTS

| | | | | |
|---|---|---|---|---|
| 2,512,105 | A * | 6/1950 | Van Marwijk Kooij | B65D 11/06 220/4.21 |
| 3,327,907 | A * | 6/1967 | Meyers | B65D 83/38 141/20 |
| 2008/0020794 | A1* | 1/2008 | Garon | A61B 5/14532 455/556.1 |
| 2008/0064339 | A1* | 3/2008 | Cavalier | F41H 9/10 455/66.1 |
| 2013/0105518 | A1* | 5/2013 | McPherson | F41H 9/10 222/153.11 |
| 2014/0204513 | A1* | 7/2014 | Del Padre | H04M 1/21 361/679.01 |
| 2017/0173616 | A1* | 6/2017 | Rocca | A45C 11/00 |

FOREIGN PATENT DOCUMENTS

| | | | |
|---|---|---|---|
| GB | 1548783 | * 4/2017 | |
| KR | 10-1201612 | * 11/2012 | A45D 34/02 |

* cited by examiner

*Primary Examiner* — Lien M Ngo

(74) *Attorney, Agent, or Firm* — Kirton McConkie; Brian Tucker

(57) ABSTRACT

A phone case can be configured to also function as a dispenser of pepper spray or another agent. The phone case can be configured to house a phone in a typical manner. Additionally, the phone case can house an agent dispensing assembly behind the phone so that it is hidden within the phone case. The agent dispensing assembly can include a trigger assembly that, when actuated, causes an agent to be sprayed from the phone case. The agent dispensing assembly may also include a key assembly that prevents the trigger assembly from being actuated unintentionally.

20 Claims, 8 Drawing Sheets

PEPPER SPRAY PHONE CASE

CROSS-REFERENCE TO RELATED APPLICATIONS

This application claims the benefit of U.S. Provisional Patent Application No. 62/761,914 which was filed on Apr. 10, 2018.

BACKGROUND

One of today's most prominent, pressing and political issues is personal safety for ourselves and our loved ones. Whether at home, in school or other public places, the world is becoming an increasingly dangerous place. The Second Amendment right to bear arms is being threatened, yet the proliferation of guns is unwittingly making every minor confrontation a potentially lethal one. Instead of the simple physical altercations of the past, the increasing presence of guns makes lethal violence much more probable. Thus, gun violence is increasing dramatically throughout the nation.

When an assailant threatens gun violence, the victim has few options. Of course, if the victim is also carrying a gun, he or she can respond with counter gun fire. Yet, even if it is justified, the counter gun fire ensures a violent and possibly deadly result. A less violent and non-lethal response would be preferred in most situations. Less violent alternatives include martial arts, pepper spray, stun guns and Tasers, but each has its shortcomings.

Even with training, few individuals are capable of disarming an assailant with martial arts. Pepper sprays can be very effective but are not in wide distribution. Also, those that carry pepper spray rarely maintain it where it is readily accessible. Few individuals carry stun guns or Tasers due to their cost. Stun guns and Tasers also require training and are dangerous if not used properly.

BRIEF SUMMARY

The present invention extends to a phone case that also functions as a dispenser of pepper spray or another agent. The phone case can be configured to house a phone in a typical manner. Additionally, the phone case can house an agent dispensing assembly behind the phone so that it is hidden within the phone case. The agent dispensing assembly can include a trigger assembly that, when actuated, causes an agent to be sprayed from the phone case. The agent dispensing assembly may also include a key assembly that prevents the trigger assembly from being actuated unintentionally.

In one embodiment, the present invention is implemented as a phone case that includes a case body having a phone portion that is configured to house a phone and an agent dispensing assembly portion that is configured to house an agent dispensing assembly. The agent dispensing assembly includes an agent capsule for storing an agent under pressure and a trigger assembly that is configured to cause the agent to be sprayed from the phone case when the trigger assembly is actuated.

In another embodiment, the present invention is implemented as a phone case that includes a case body that is configured to house a phone and an agent dispensing assembly. The case body forms a nozzle opening and a trigger assembly opening. The agent dispensing assembly comprises an agent capsule that stores an agent, a trigger assembly and a nozzle. The trigger assembly includes an exhaust valve and an actuator. The actuator extends through the trigger assembly opening while the nozzle extends through the nozzle opening.

In another embodiment, the present invention is implemented as a phone case that includes a case body having a phone portion that includes one or more buttons or openings corresponding to one or more buttons or openings of a phone and an agent dispensing assembly portion that includes a key assembly opening, a trigger assembly opening, a nozzle opening and a filling valve opening. The phone case also includes an agent dispensing assembly that includes an agent capsule, a trigger assembly, a key assembly and a nozzle assembly. The agent capsule includes a filling valve that is positioned within the filling valve opening. The trigger assembly includes an actuator that is positioned within the trigger assembly opening. The key assembly includes a key that is positioned within the key assembly opening. The nozzle assembly includes a nozzle that is positioned within the nozzle opening.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

In this specification and the claims, the term "agent" should be construed as encompassing pepper spray and any other agent that is capable of being sprayed for the purpose of disarming, incapacitating or otherwise deterring an individual. The term "phone case" should be construed as a case that is configured to house a smart phone, portable media player (e.g., an iPod) or any other similar device (collectively "phone").

Figure 1A:
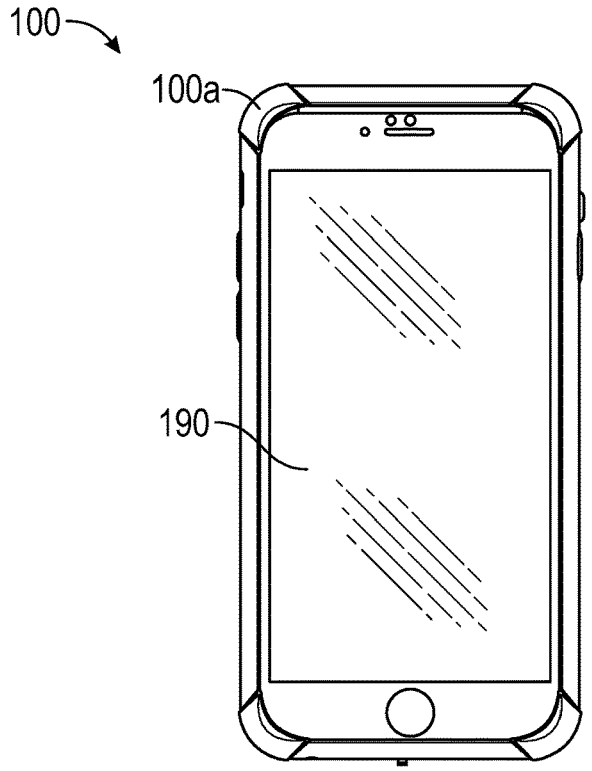
FIGS. 1A-1C provide front, side and perspective views of a phone case that is configured in accordance with embodiments of the present invention.
Figure 1B:
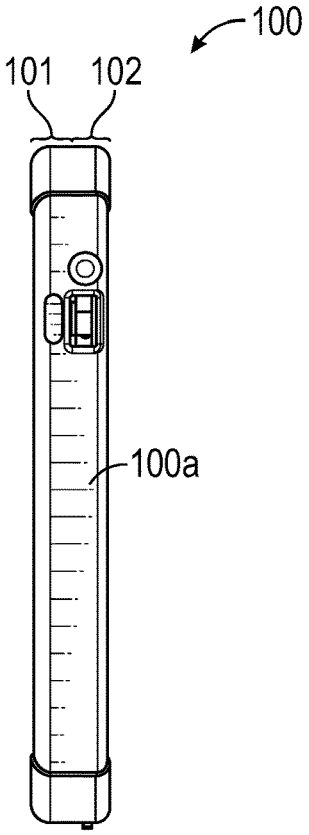
Figure 1C:
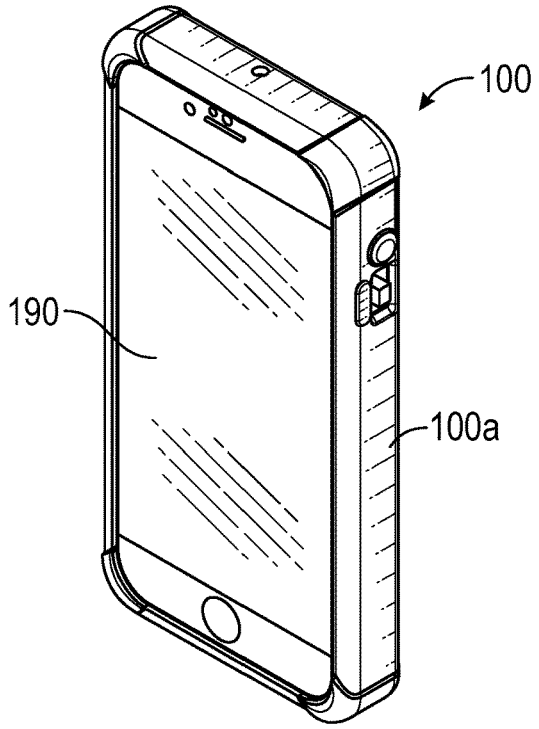

FIGS. 1A-1C provide front, side and front-perspective views respectively of a phone case 100 that is configured in accordance with embodiments of the present invention. Phone case 100 includes a case body 100*a* that can be viewed as having a phone portion 101 and an agent dispensing assembly portion 102. Phone portion 101 is positioned towards the front of case body 100*a* while agent dispensing assembly portion 102 is positioned towards the back of case body 100*a*.

Figure 2A:
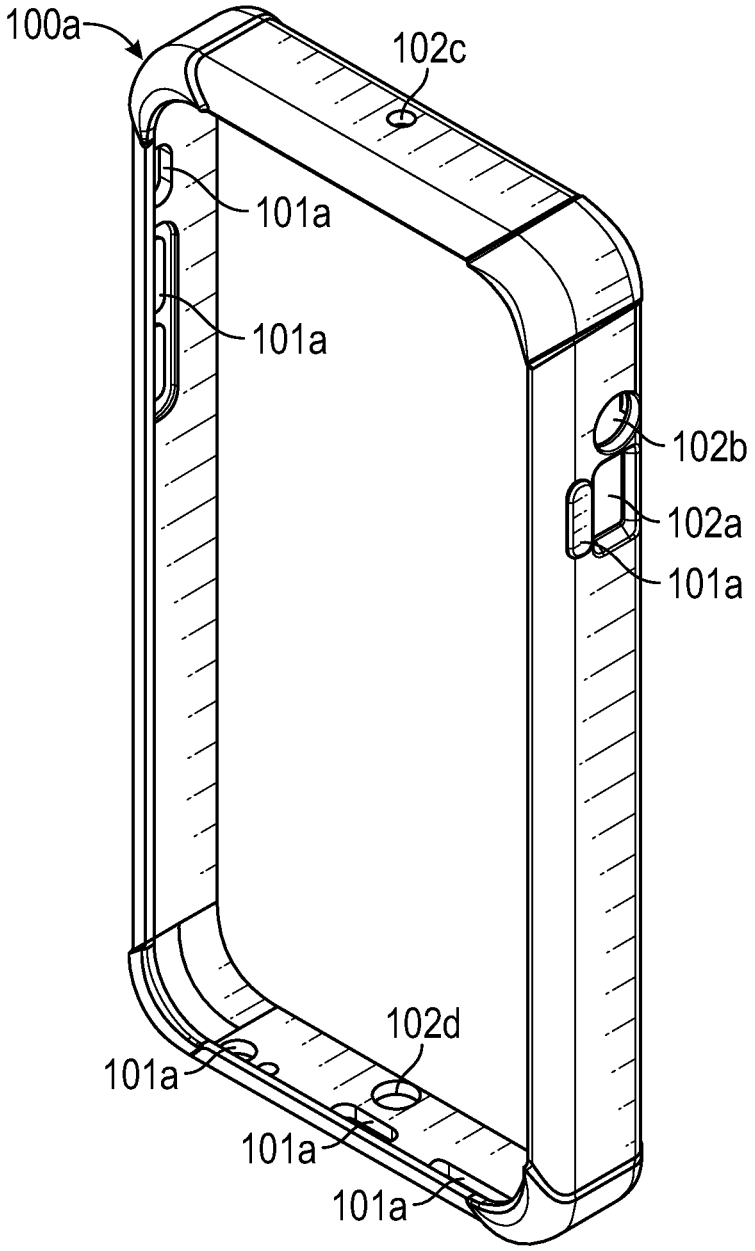
FIG. 2A illustrates the phone case with the agent dispensing assembly removed from the case body.
Figure 2B:
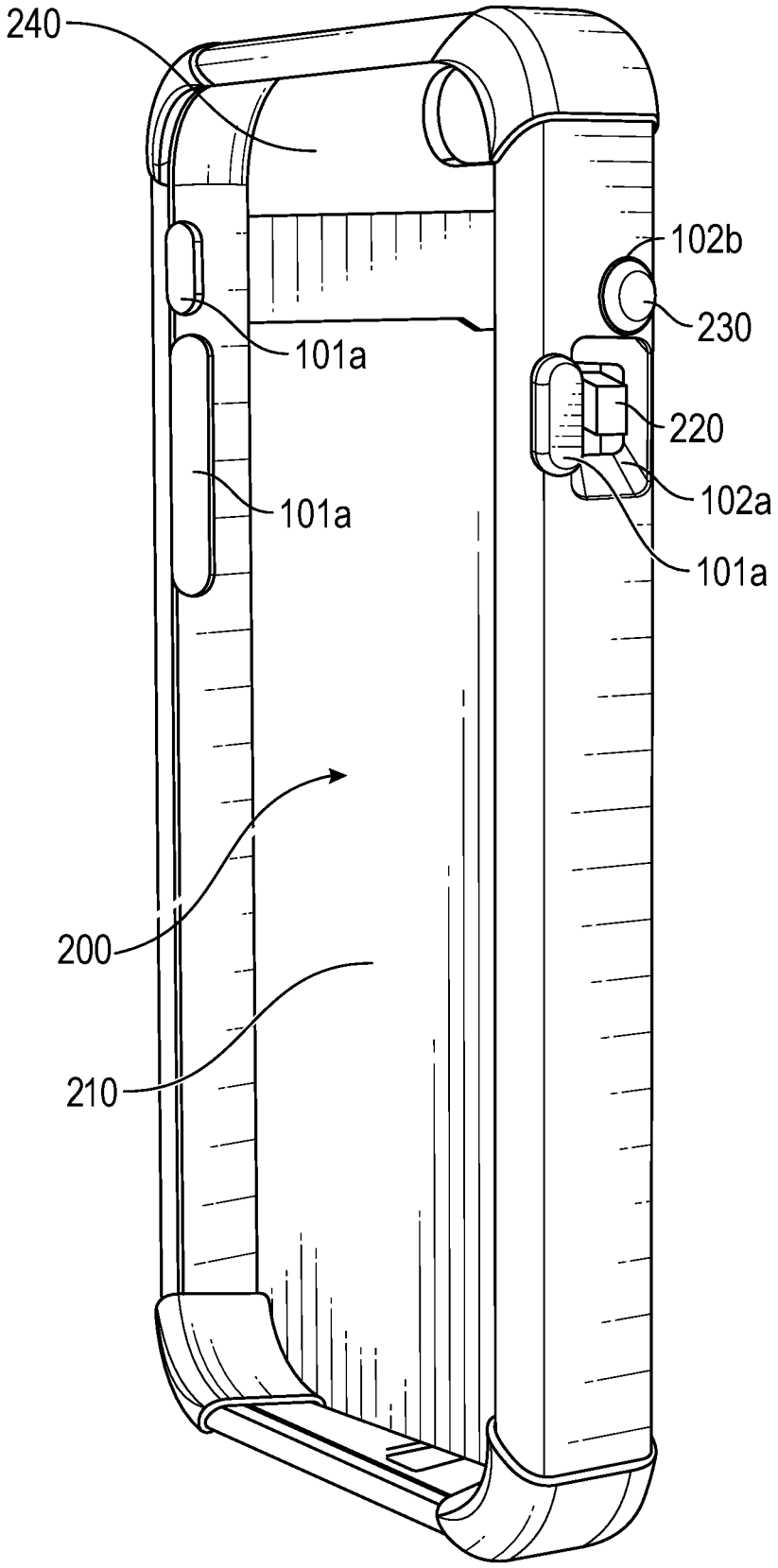
FIG. 2B illustrates the phone case with the agent dispensing assembly positioned within the case body.

FIG. 2A illustrates case body 100*a* in isolation, while FIG. 2B illustrates case body 100*a* with an agent dispensing assembly 200 housed therein. Agent dispensing assembly 200 includes an agent capsule 210, a key assembly 220, a trigger assembly 230 and a nozzle assembly 240.

Phone portion 101 of case body 100*a* can include a number of buttons and openings 101*a* that correspond with the type of phone with which phone case 100 is intended to be used. For example, in the depicted embodiment, buttons and openings 101*a* are designed for an iPhone 6s. In contrast, agent dispensing assembly portion 102 of case body 100*a* can include a key assembly opening 102*a* corresponding to key assembly 220, a trigger assembly opening 102*b* corresponding to trigger assembly 230, a nozzle opening 102*c* corresponding to nozzle assembly 240 and a filling valve opening 102*d* that aligns with agent capsule 210.

As is shown in FIG. 2B, agent dispensing assembly portion 102 is configured to retain agent dispensing assembly 200 towards the back of phone case 100 such that phone 190 will be positioned overtop agent dispensing assembly 200 when phone 190 is secured within phone case 100. As a result, agent dispensing assembly 200 will be hidden within phone case 100.

Figure 3:
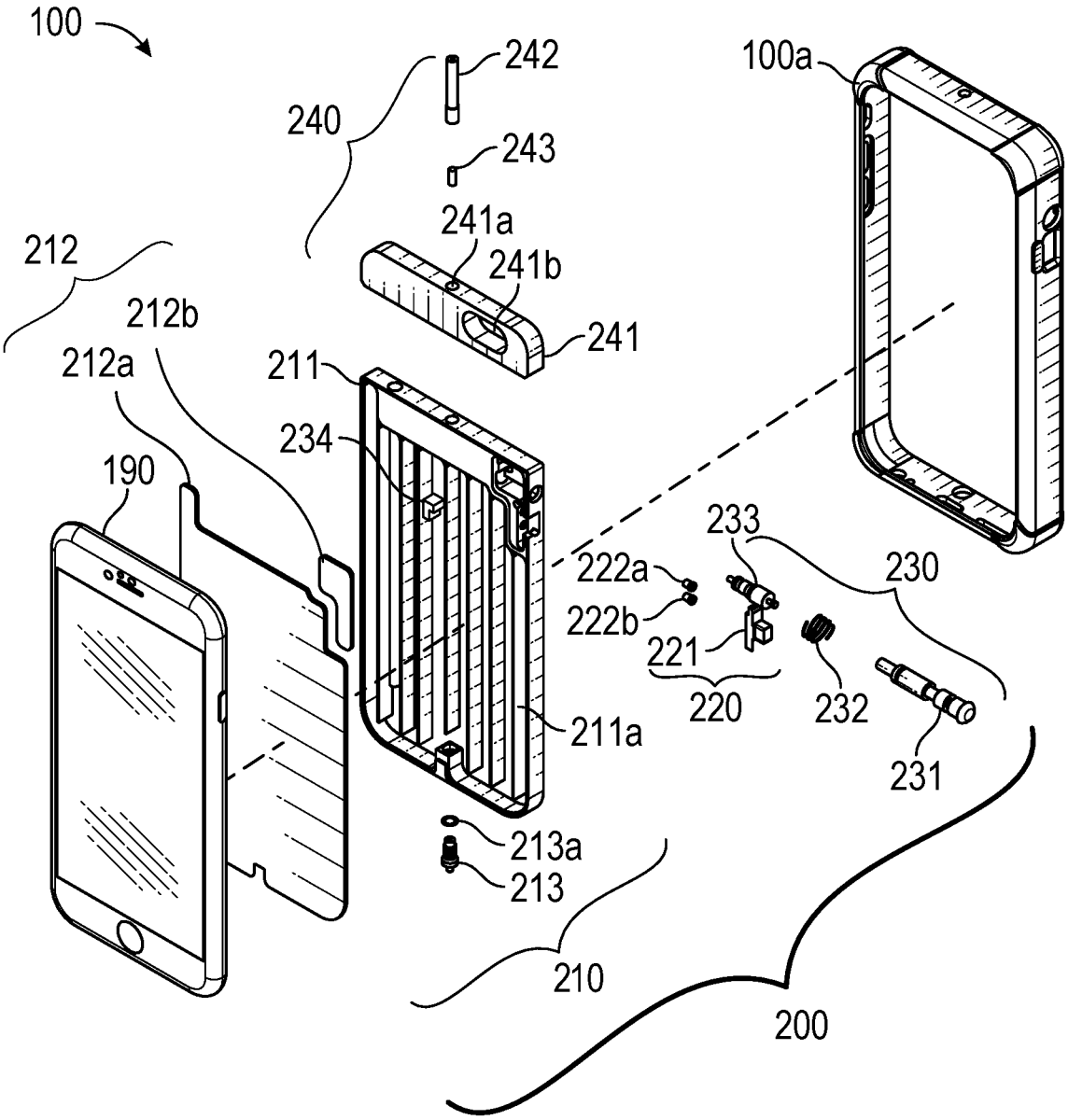
FIG. 3 illustrates an exploded view of the phone case.

FIG. 3 provides an exploded view of phone case 100 to better illustrate the components of agent dispensing assembly 200. Agent capsule 210 is configured to store a pressurized agent such as pepper spray. Agent capsule 210 includes an agent housing 211 that has a generally rectangular shape that corresponds with the shape and size of case body 100*a* (i.e., with the shape and size of a phone). Agent housing 211 defines an interior 211*a* for storing the pressurized agent. Agent capsule 210 can also include a cover 212 that may be comprised of a first cover 212*a* and a second cover 212*b*. Cover 212 is configured to attach to agent housing 211 overtop interior 211*a*. In some embodiments, agent housing 211 and cover 212 can be formed of metal to thereby allow agent capsule 210 to store the agent under high pressure. By using metal, the inherently weak rectangular shape will be able to withstand the outward forces the agent will apply when stored under pressure. Agent capsule 210 also includes a filling valve 213 that may be positioned at the bottom of agent housing 211. Filling valve 213 can employ an O-ring 213*a* to form a pressure-tight seal.

Key assembly 220 is positioned within agent capsule 210 and is configured to function as a safety mechanism to prevent the unintended spraying of the agent. Key assembly 220 includes a key 221 and biasing members 222*a*, 222*b*. Trigger assembly 230 is also positioned within agent capsule 210 and is configured to cause the agent to be sprayed from phone case 100 when actuated. Trigger assembly 230 includes an actuator 231, a spring 232, an exhaust valve 233 and a stop 234.

Nozzle assembly 240 is positioned on top of agent capsule 210 and includes a nozzle support 241, a nozzle 242 and a nozzle coupling member 243. Nozzle support 241 includes a nozzle opening 241*a* through which nozzle 242 extends. Nozzle support 241 may also include one or more openings 241*b* that correspond with a camera, sensor or other rear-facing component of phone 190. Although not visible, case body 100*a* would include corresponding opening(s) (see FIGS. 6 and 6A).

Figure 4:
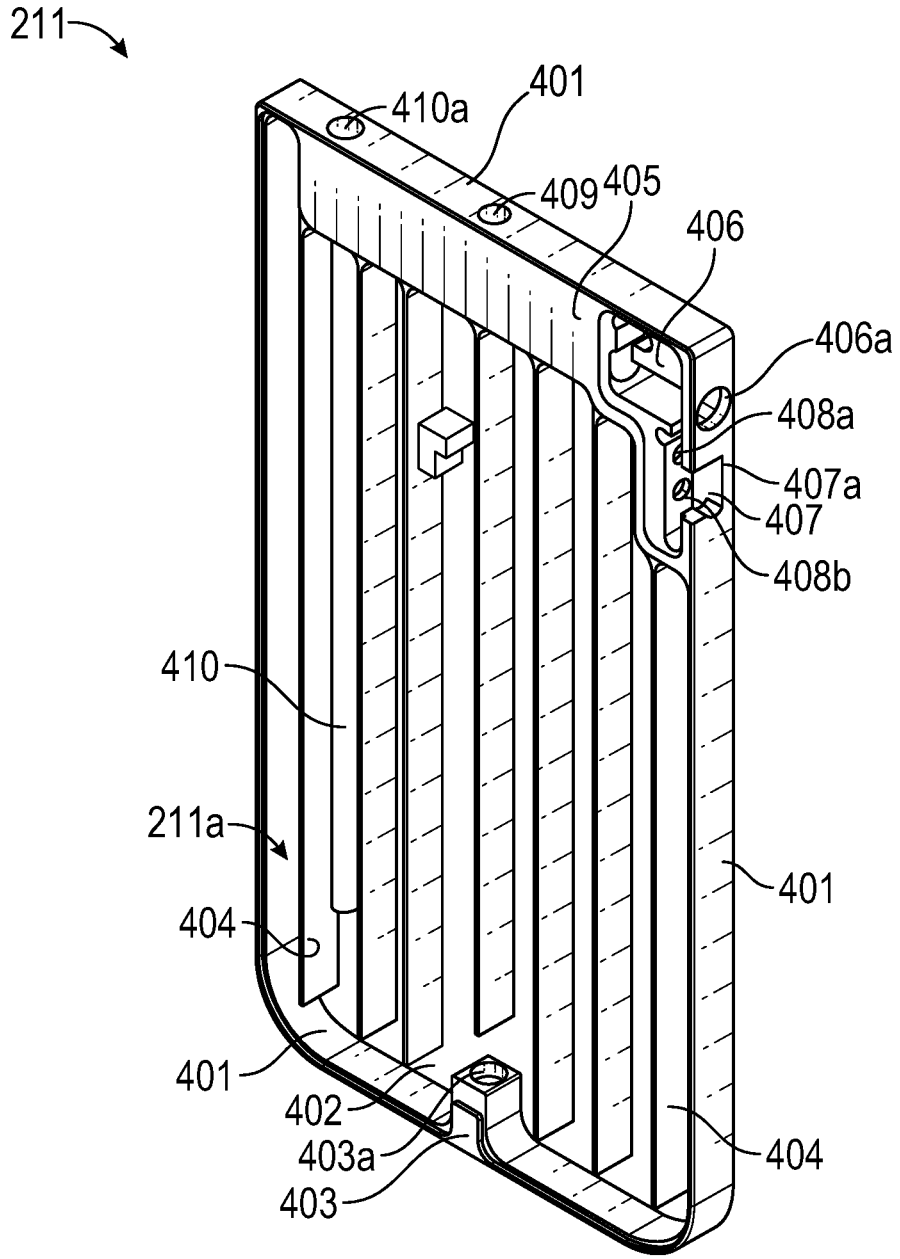
FIG. 4 illustrates an agent housing of the agent dispensing assembly with the cover removed to reveal its interior.

FIG. 4 provides a more detailed view of agent housing 211. Agent housing 211 can be defined by side wall 401 that forms the generally rectangular shape and a rear wall 402 that extends between side wall 401. Cover 112 can be configured to attach to side wall 401 to thereby form the sealed interior 211*a*. Side wall 401 can form a filling valve support 403 that is preferably positioned at the bottom of agent housing 211 but could be formed at another position along side wall 401. Filling valve support 403 forms a filling valve opening 403*a* for receiving and retaining filling valve 213. Agent housing 211 can also include a number of ribs 404 that extend from and along rear wall 402 and function to reinforce agent housing 211. In some embodiments, cover 112 may be attached (e.g., welded) to ribs 404. By extending lengthwise within interior 211*a*, ribs 404 can prevent agent housing 211 from bulging outwardly due to the pressurized agent.

A valve housing 405 is formed at the top of agent housing 211 and defines a trigger assembly compartment 406 within which trigger assembly 230 is housed and a key assembly compartment 407 within which key assembly 220 is housed. In some embodiments, second cover 212*b* can be configured to fit overtop trigger assembly compartment 406 and key assembly compartment 407. An actuator opening 406*a* and a key opening 407*a* can be formed through side wall 401 to allow actuator 231 and key 221 respectively to extend through side wall 401. A pair of slots 408*a*, 408*b* can be formed in an interior wall of key assembly compartment 407 and can be configured to receive biasing members 222*a*, 222*b* of key assembly 220.

Although not visible in FIG. 4, trigger assembly compartment 406 can extend within valve housing 405 along the top side wall 401. A nozzle opening 409 can be formed through side wall 401 and into trigger assembly compartment 406. A pipe 410 can be employed to connect trigger assembly compartment 406 to interior 211*a* of agent housing 211. As shown, a top end 410*a* of pipe 410 can be secured within side wall 401 and a bottom end 410*b* of pipe 410 can be positioned within interior 211*a*. Pipe 410 can include one or more openings that are positioned within or oriented towards trigger assembly compartment 406 such that the agent can flow from interior 211*a* to trigger assembly compartment 406 as will be described below.

Figure 5A:
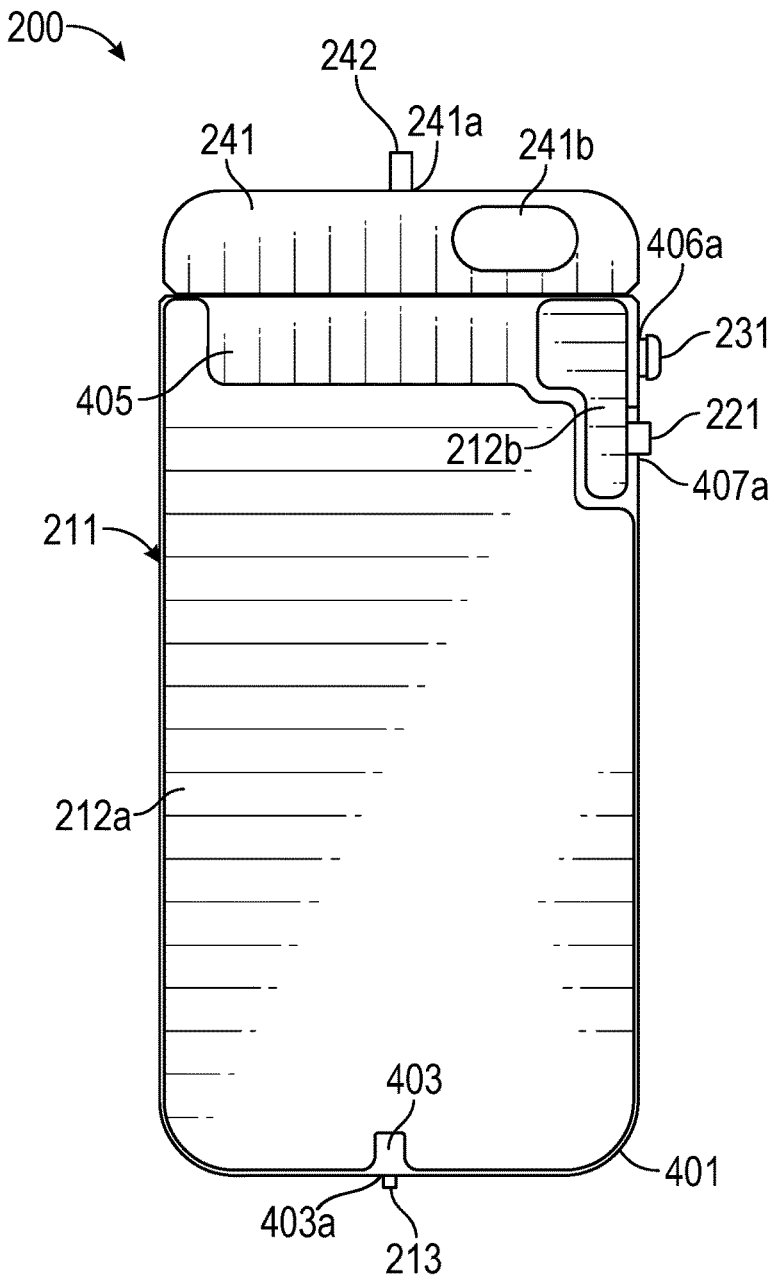
FIGS. 5A and 5B provide front and side views of the agent dispensing assembly.
Figure 5B:
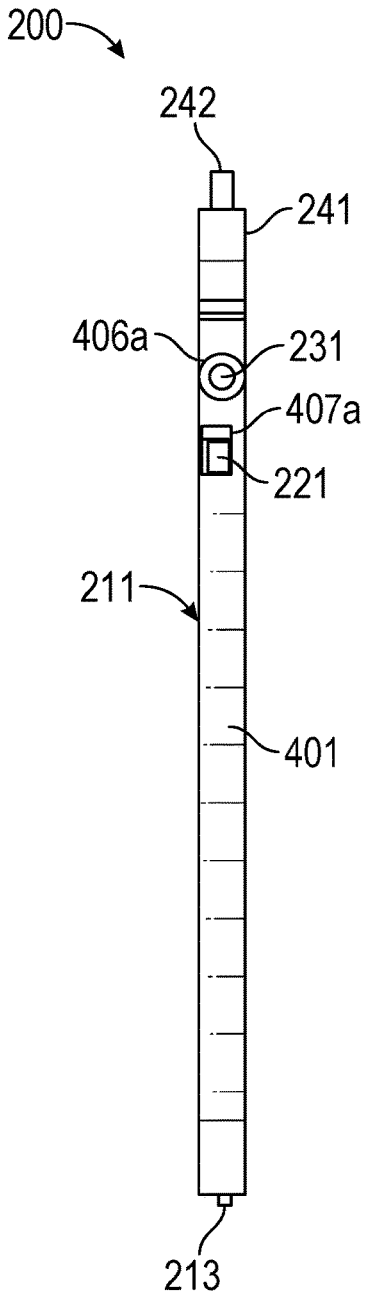

FIGS. 5A and 5B provide front and side views of an assembled agent dispensing assembly 200 when isolated from case body 100*a*. As shown, first cover 212*a* is secured overtop interior 211*a* and second cover 212*b* is secured overtop trigger assembly compartment 406 and key assembly compartment 407. Filling valve 213, actuator 231 and key 221 extend outwardly beyond side wall 401 through filling valve opening 403*a*, actuator opening 406*a* and key opening 407*a* respectively. Nozzle support 241 is coupled to agent housing 211 with nozzle 242 extending upwardly through nozzle opening 241*a*.

Figure 6:
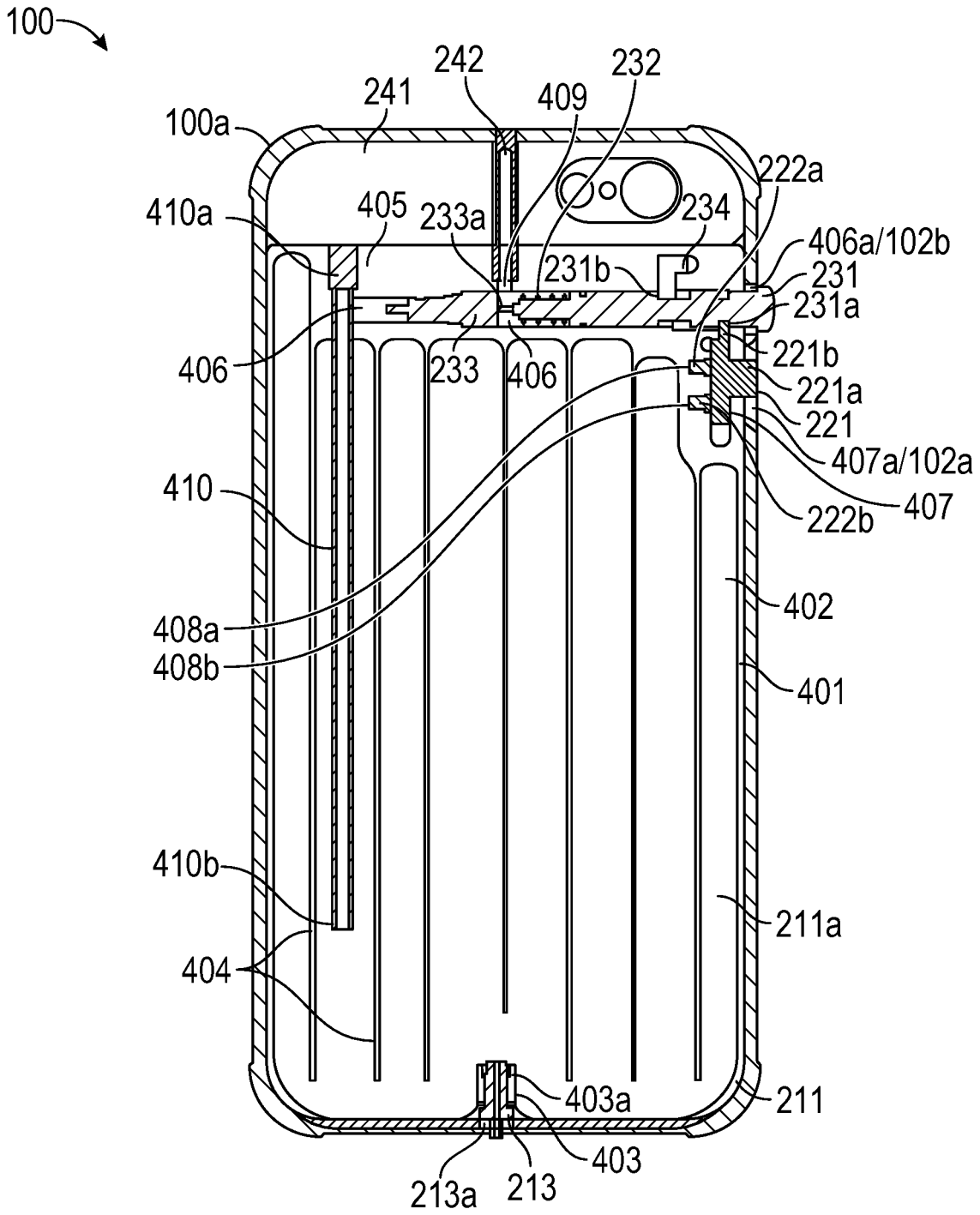
FIG. 6 illustrates a cross-sectional front view of the phone case when the trigger assembly is not actuated.

The functionality of agent dispensing assembly 200 will now be described with reference to FIGS. 6 and 6A each of which provides a cross-sectional front view of phone case 100. FIG. 6 shows that filling valve 213 is secured within filling valve opening 403*a* of filling valve support 403. O-ring 213*a* can ensure that a pressure-tight seal is formed. Filling valve 213 can be configured to enable an agent to be injected into interior 211*a*. For example, a pressurized canister of agent could be coupled to filling valve 213 which would open and allow the agent to flow into interior 211*a*. In this way, filling valve 213 allows agent capsule 210 to be filled and refilled.

Pipe 410 provides a pathway by which the agent may flow from interior 211*a* to trigger assembly compartment 406. Exhaust valve 233 can be positioned within trigger assembly compartment 406 to prevent the agent from escaping from trigger assembly compartment 406 absent actuation of trigger assembly 230. In particular, exhaust valve 233 is positioned between pipe 410 and nozzle opening 409 so that the agent cannot reach nozzle opening 409 unless exhaust valve 233 is open. The dimensions of trigger assembly compartment 406 can be designed to ensure that an air-tight seal is formed between the outer surfaces of exhaust valve 233 and the inner walls of trigger assembly 406.

Key 221 is positioned within key assembly housing 407. Key 221 is coupled to biasing members 222*a*, 222*b* which are inserted into slots 408*a*, 408*b* and function to bias key 221 upwardly towards trigger assembly compartment 406. Key 221 forms a slider tab 221*a* that extends outwardly through/into key opening 407*a* and key assembly opening 102*a*. Key 221 also forms a locking tab 221*b* that extends into trigger assembly compartment 406. Slider tab 221*a* allows a user to apply a downward force against key 221. This downward force will cause key 221 to slide downwardly thereby withdrawing locking tab 221*b* from trigger assembly compartment 406. Actuator 231 can be configured with a locking notch 231*a* into which locking tab 221*b* inserts. The interaction of locking notch 231*a* and locking tab 221*b* prevents actuator 231 from being pressed inwardly without first sliding key 221 downwardly.

Actuator 231 extends outwardly through/into actuator opening 406*a* and trigger assembly opening 102*b* to allow the user to apply an inward force against actuator 231. Actuator 231 may be positioned adjacent to key 221 to enable the user to slide key 221 downwardly while simultaneously depressing actuator 231 with a single thumb or finger. Additionally, actuator 231 and key 221 can be positioned in the general region where a user's thumb will be while handling a phone.

Actuator 231 extends into trigger assembly compartment 406 up to a pin 233*a* or other actuating element of exhaust valve 233. Spring 232 is positioned within trigger assembly compartment 406 to apply an outward force against actuator 231 to thereby bias actuator 231 into the position shown in FIG. 6. As with exhaust valve 233, the dimensions of trigger assembly compartment 406 can be designed to ensure that an air-tight seal is formed between the outer surfaces of actuator 231 and the inner walls of trigger assembly 406. One or more sealing members can also be employed to provide this seal.

Stop 234 is housed within valve housing 405 and extends into trigger assembly compartment 406. A slot 231*b* is formed in actuator 231 and receives stop 234. The interaction of stop 234 and slot 231*b* prevent actuator 231 from being over-inserted into trigger assembly compartment 406.

Figure 6A:
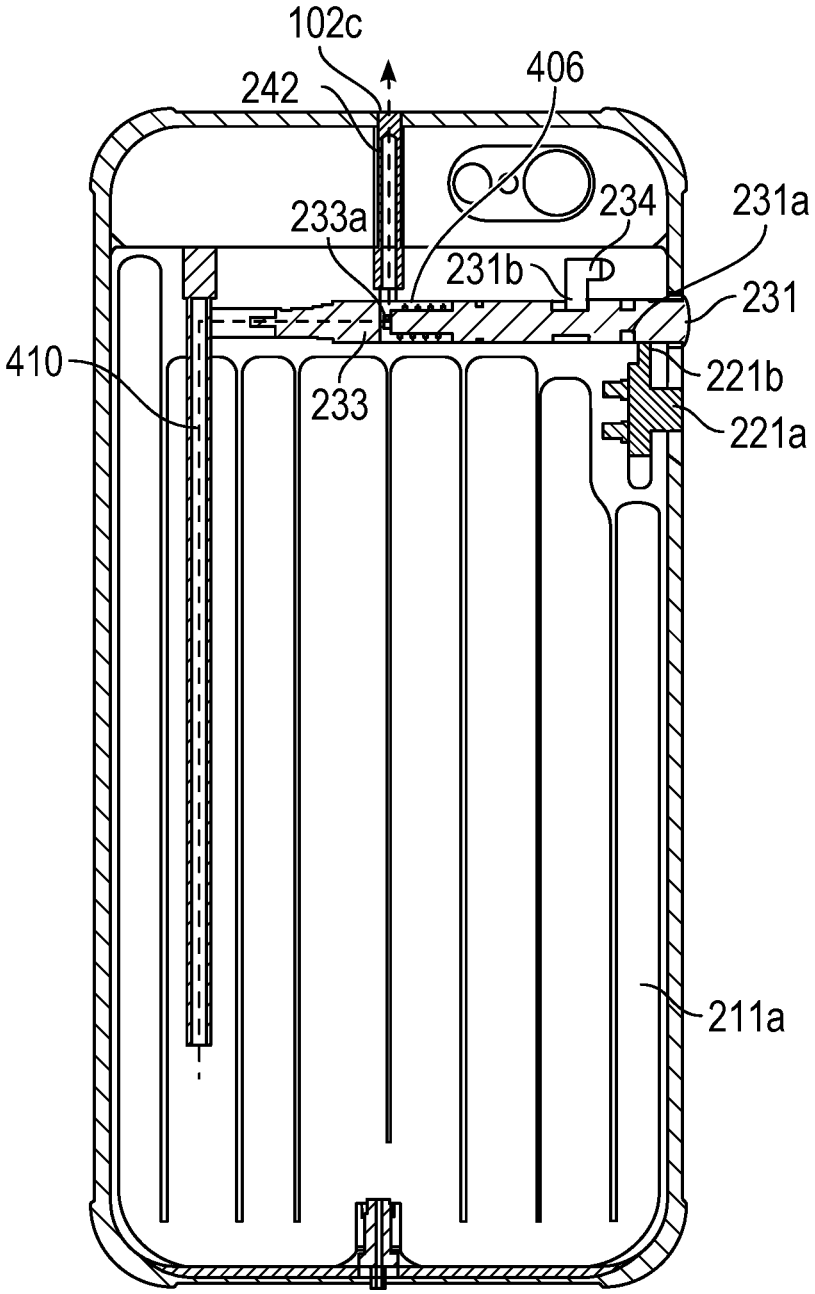
FIG. 6A illustrates a cross-sectional front view of the phone case when the trigger actuated is actuated to thereby cause the agent to be sprayed.

Turning to FIG. 6A, it is assumed that the user has applied a downward force on slider tab 221*a* to withdraw locking tab 221*b* from locking notch 231*a* while also applying an inward force on actuator 231. As a result, actuator 231 has moved into trigger assembly compartment 406 to depress pin 233*a*. This inward movement is halted as stop 234 contacts the wall of slot 231*b*. With pin 233*a* depressed, exhaust valve 233 is opened thereby allowing the agent to flow from interior 211*a*, through pipe 410, into trigger assembly compartment 406, through nozzle 242 and out nozzle opening 102*c*. Because the agent is pressurized within interior 211*a*, it will be sprayed from nozzle opening 102*c*.

While the user maintains an inward force on actuator 231, this pathway will remain open and agent will continue to be sprayed until the pressure has been diminished. If the user ceases to apply the inward force, spring 232 will apply an outward force against actuator 231 to cause it to return to its original position. With actuator 231 returned to this original position, biasing members 222*a*, 222*b* will cause locking tab 221*b* to be reinserted into locking notch 231*a* thereby preventing re-actuation without first unlocking key 221.

As can be seen, the design of phone case 100 facilitates the dispensing of an agent in a quick and efficient manner. In particular, because most individuals carry their phones with them at all times and keep their phones readily accessible, they will be able to dispense an agent in the short amount of time that it takes to retrieve their phone. For example, if an individual who carries his phone in his pocket is attacked, he will be able to extract the phone from his pocket, grip it in a typical fashion (e.g., in the right hand with the thumb positioned along the top, right side), and slide key 221 and depress actuator 231 simultaneously with his thumb to spray the assailant in the eyes. By positioning nozzle opening 102*c* at the top, phone case 100 will be in the proper orientation for spraying the assailant when the phone is being held in a typical manner (e.g., as the user would hold the phone will looking at it). Additionally, because agent dispensing assembly 200 is substantially hidden within phone case 100, the assailant will not be able to readily determine that the individual has retrieved an agent. Therefore, phone case 100 can retain the element of surprise.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A phone case comprising:

a case body having a rectangular shape corresponding to a rectangular shape of a phone, the case body having a front surface forming a screen opening, a flat back surface and sidewalls extending between the front surface and the flat back surface, a front portion of the sidewalls defining a phone portion of the case body that is configured to house the hone with the screen opening exposing a screen of the phone, a back portion of the sidewalls defining an agent dispensing assembly portion of the case body that is configured to house an agent dispensing assembly such that, when the phone is housed within the phone portion of the case body, the agent dispensing assembly is hidden between the phone and the flat back surface, wherein the front portion of the sidewalls includes one or more buttons or openings that correspond with one or more input components of the phone;

the agent dispensing assembly that is housed within the back portion of the sidewalls of the case body, the agent dispensing assembly including an agent capsule for storing an agent under pressure and a trigger assembly that is configured to cause the agent to be sprayed from the phone case when the trigger assembly is actuated.

2. The phone case of claim 1, wherein the back portion of the sidewalls includes a trigger assembly opening corresponding with the trigger assembly of the agent dispensing assembly and a nozzle opening corresponding with a nozzle from which the agent is sprayed.

3. The phone case of claim 1, wherein the agent dispensing assembly also includes a key assembly that prevents the trigger assembly from being actuated unintentionally.

4. The phone case of claim 1, wherein the agent capsule includes a filling valve by which the agent can be injected into the agent capsule.

5. The phone case of claim 1, wherein the agent capsule comprises an agent housing that forms an interior in which the agent is stored under pressure and a valve housing that defines a trigger assembly compartment within which the trigger assembly is positioned, the interior of the agent housing being fluidly connected to the trigger assembly compartment.

6. The phone case of claim 5, wherein the trigger assembly includes an exhaust valve that is positioned within the trigger assembly compartment and prevents flow of the agent through the trigger assembly compartment.

7. The phone case of claim 6, wherein the agent dispensing assembly includes a nozzle that extends between the trigger assembly compartment and a nozzle opening formed in the case body, the exhaust valve being positioned between the nozzle and the interior of the agent housing.

8. The phone case of claim 7, wherein the trigger assembly includes an actuator that is configured to open the exhaust valve.

9. The phone case of claim 8, wherein the actuator extends through a trigger assembly opening in the case body to thereby allow a user to apply a force on the actuator to cause the exhaust valve to open.

10. The phone case of claim 9, wherein the agent dispensing assembly also includes a key assembly, the key assembly including a key that interfaces with the actuator to prevent the actuator from opening the exhaust valve without first moving the key.

11. The phone case of claim 10, wherein the key includes a slider tab that extends through a key assembly opening in the case body to thereby allow the user to apply a force on the key.

12. The phone case of claim 1, wherein the agent capsule comprises an agent housing having a rectangular shape defined by a side wall, a rear wall and one or more covers, the agent housing forming an interior within which the agent is stored, the agent housing also including a plurality of ribs that extend within the interior.

13. The phone case of claim 12, wherein the agent housing forms a valve housing separate from the interior, the valve housing forming a trigger assembly compartment within which the trigger assembly is contained.

14. The phone case of claim 13, wherein the valve housing also forms a key assembly compartment.

15. The phone case of claim 13, wherein the trigger assembly includes an exhaust valve that forms a barrier between the interior of the agent housing and at least a portion of the trigger assembly compartment, the trigger assembly including an actuator that is configured to open the exhaust valve when a user applies a force on the actuator to thereby cause the agent to flow from the interior of the agent housing, through the exhaust valve and to then be sprayed from the phone case.

16. A phone case comprising:

a case body having a rectangular shape corresponding to a rectangular shape of a phone, the case body having a front surface forming a screen opening, a back surface and sidewalls extending between the front surface and the back surface, a front portion of the sidewalls defining a phone portion of the case body that is configured to house the phone with the screen opening exposing a screen of the phone, a back portion of the sidewalls defining an agent dispensing assembly portion of the case body that is configured to house an agent dispensing assembly such that, when the phone is housed within the phone portion of the case body, the agent dispensing assembly is hidden between the phone and the back surface, wherein the front portion of the sidewalls includes one or more buttons or openings that correspond with one or more input components of the phone, and wherein the back portion of the sidewalls includes a nozzle opening and a trigger assembly opening;

wherein the agent dispensing assembly comprises an agent capsule that stores an agent, a trigger assembly and a nozzle, the trigger assembly including an exhaust valve and an actuator, the actuator extending through the trigger assembly opening in the back portion of the sidewalls of the case body and the nozzle extending through the nozzle opening in the back portion of the sidewalls of the case body.

17. The phone case of claim 16, wherein the agent dispensing assembly also comprises a key assembly that includes a key, the key extending through a key assembly opening formed in the back portion of the sidewalls of the case body, the key assembly interfacing with the trigger assembly to prevent the trigger assembly from being actuated unintentionally.

18. The phone case of claim 16, wherein the agent capsule includes an agent housing that forms an interior and a valve housing, the trigger assembly and the key assembly being contained within the valve housing.

19. A phone case comprising:

a case body having a rectangular shape corresponding to a rectangular shape of a phone, the case body having a front surface forming a screen opening, a back surface and sidewalls extending between the front surface and the back surface, a front portion of the sidewalls defining a phone portion of the case body that is configured to house the phone with the screen opening exposing a screen of the phone, a back portion of the sidewalls defining an agent dispensing assembly portion of the case body that is configured to house an agent dispensing assembly such that, when the phone is housed within the phone portion of the case body, the agent dispensing assembly is hidden between the phone and the back surface, wherein the front portion of the sidewalls includes one or more buttons or openings that correspond with one or more input components of the phone, and wherein the back portion of the sidewalls includes a key assembly opening, a trigger assembly opening, a nozzle opening and a filling valve opening;

an agent dispensing assembly that includes an agent capsule, a trigger assembly, a key assembly and a nozzle assembly, the agent capsule including a filling valve that is positioned within the filling valve opening in the back portion of the sidewalls, the trigger assembly including an actuator that is positioned within the trigger assembly opening in the back portion of the sidewalls, the key assembly including a key that is positioned within the key assembly opening in the back portion of the sidewalls and the nozzle assembly including a nozzle that is positioned within the nozzle opening in the back portion of the sidewalls.

20. The phone case of claim 19, wherein the trigger assembly includes an exhaust valve that is opened when a force is applied to the actuator, the exhaust valve being positioned between the nozzle and an agent housing of the agent capsule, the agent housing storing an agent under pressure such that, when the exhaust valve is opened, the agent flows through the exhaust valve and is sprayed from the nozzle.

* * * * *